United States Patent [19]

Gal

[11] Patent Number: 4,735,007

[45] **Date of Patent: * Apr. 5, 1988**

[54] GRIP AND STOCK ASSEMBLY FOR FACILITATING USE OF A COMPACT GUN

[75] Inventor: Uzi Gal, North Wales, Pa.

[73] Assignee: Uzi R & D Associates, New York, N.Y.

[ * ] Notice: The portion of the term of this patent subsequent to Apr. 30, 2002 has been disclaimed.

[21] Appl. No.: 857,193

[22] Filed: Apr. 29, 1986

Related U.S. Application Data

[63] Continuation-in-part of Ser. No. 728,296, Apr. 29, 1985, Pat. No. 4,640,036, which is a continuation of Ser. No. 448,828, Dec. 10, 1982, Pat. No. 4,513,523.

[51] Int. Cl.[4] ..... F41C 23/00

[52] U.S. Cl. ..... 42/72; 42/73

[58] Field of Search ..... 42/71.01, 72, 73, 71.02

[56] References Cited

U.S. PATENT DOCUMENTS

| | | | |
|---|---|---|---|
| 2,200,780 | 5/1940 | Schmeisser | 42/72 |
| 3,817,148 | 6/1974 | Schirneker | 42/73 X |
| 4,513,523 | 4/1985 | Gal | 42/72 |
| 4,640,036 | 2/1987 | Gal | 42/72 |

*Primary Examiner*—Ted L. Parr

*Attorney, Agent, or Firm*—Fleit, Jacobson, Cohn & Price

[57] ABSTRACT

A grip and folding stock assembly mounted and arranged on a compact gun for facilitating use of the gun in various firing positions. An L-shaped bracket has one end secured to the distal end of a pistol grip emanating from the undersurface of the receiver of the gun, and the other end secured to the undersurface of the rearward end of the receiver. Mounted in this way, the bracket defines a forearm receiving portion for stabilizing the gun while firing. A folding stock is pivotally mounted to the rearward end of the receiver of the weapon. The stock is operative between three positions. In a first position, the stock is folded and brought into close proximity to the pistol grip. In a second position, the stock is placed into a position suitable for shoulder firing. In a third position, the stock is placed into a position suitable for underarm firing. A cartridge magazine of improved construction fits within the pistol grip. A trigger guard is provided just ahead of the pistol grip and completely surrounds and protects the trigger of the weapon. A handgrip forms part of the trigger guard. The handgrip performs the simultaneous functions of defining a portion of the trigger guard and providing a grip for holding the gun during firing.

32 Claims, 10 Drawing Sheets

FIG. 5
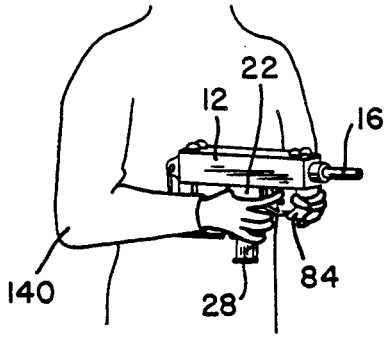
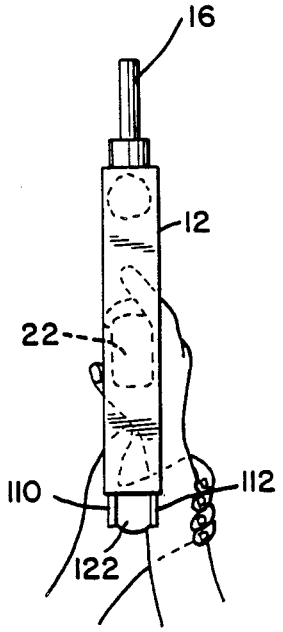
FIG. 8
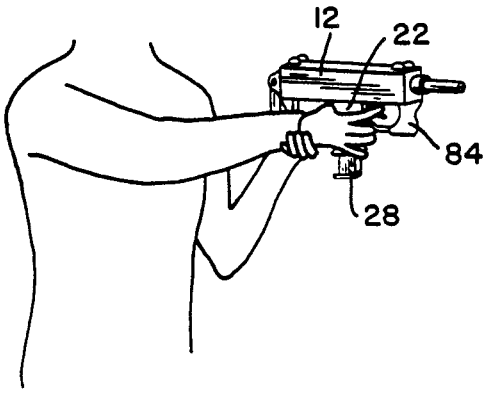
FIG. 7
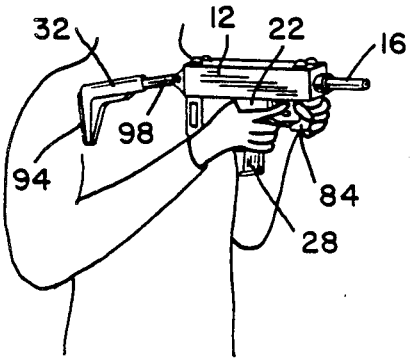
FIG. 6

FIG. 19
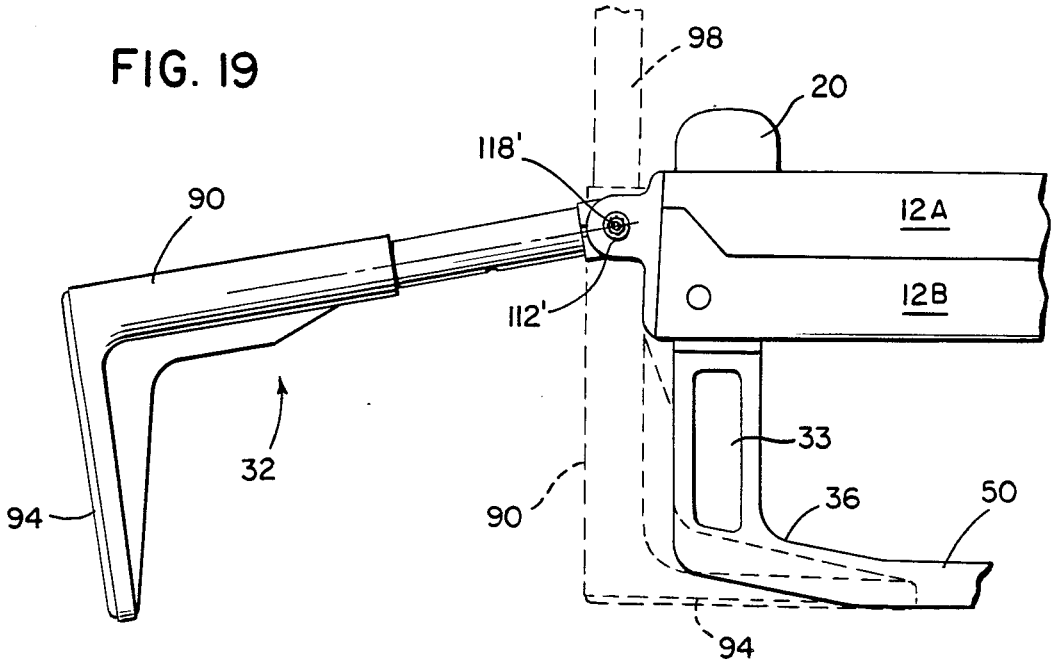
FIG. 20
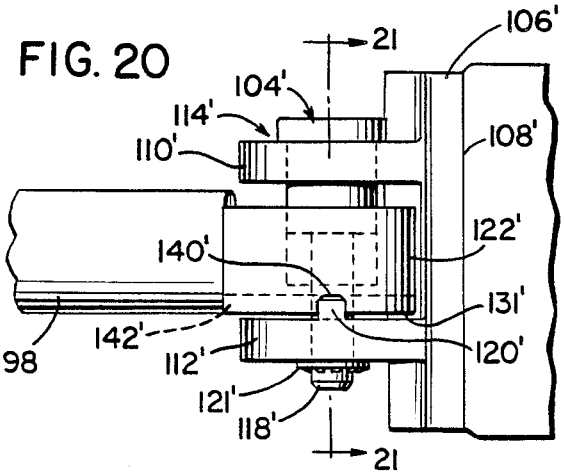
FIG. 21
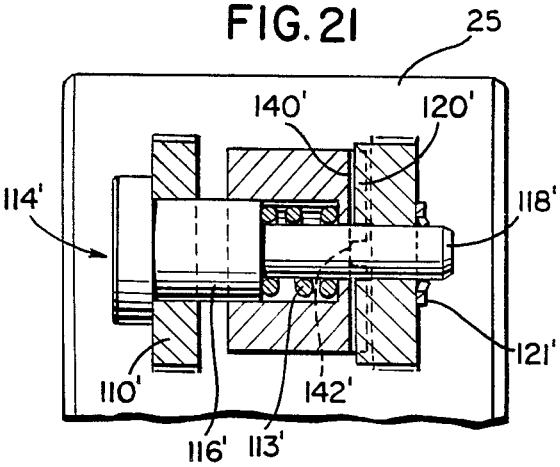
FIG. 24
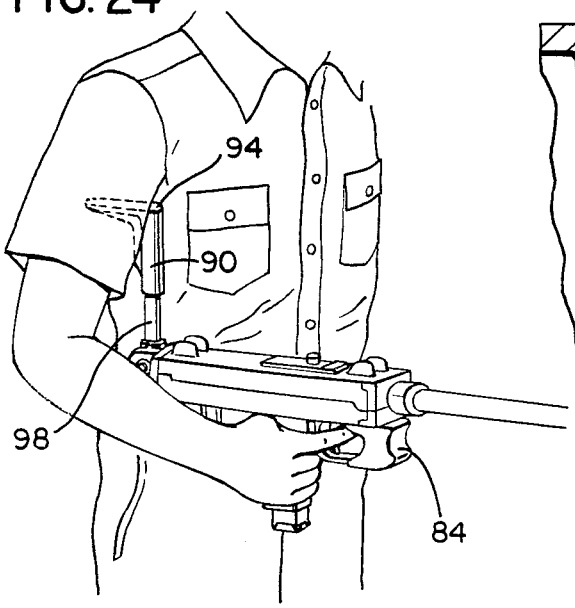
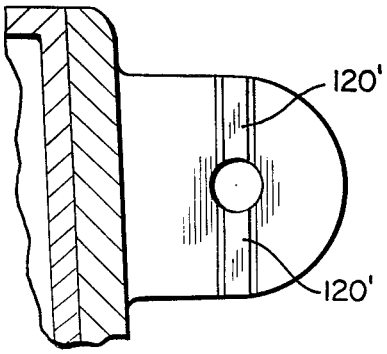
FIG. 22
FIG. 23
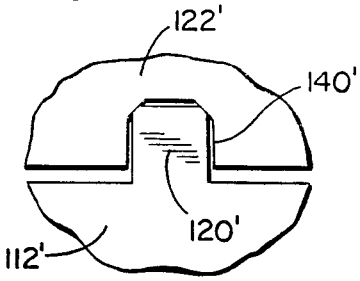

FIG. 28
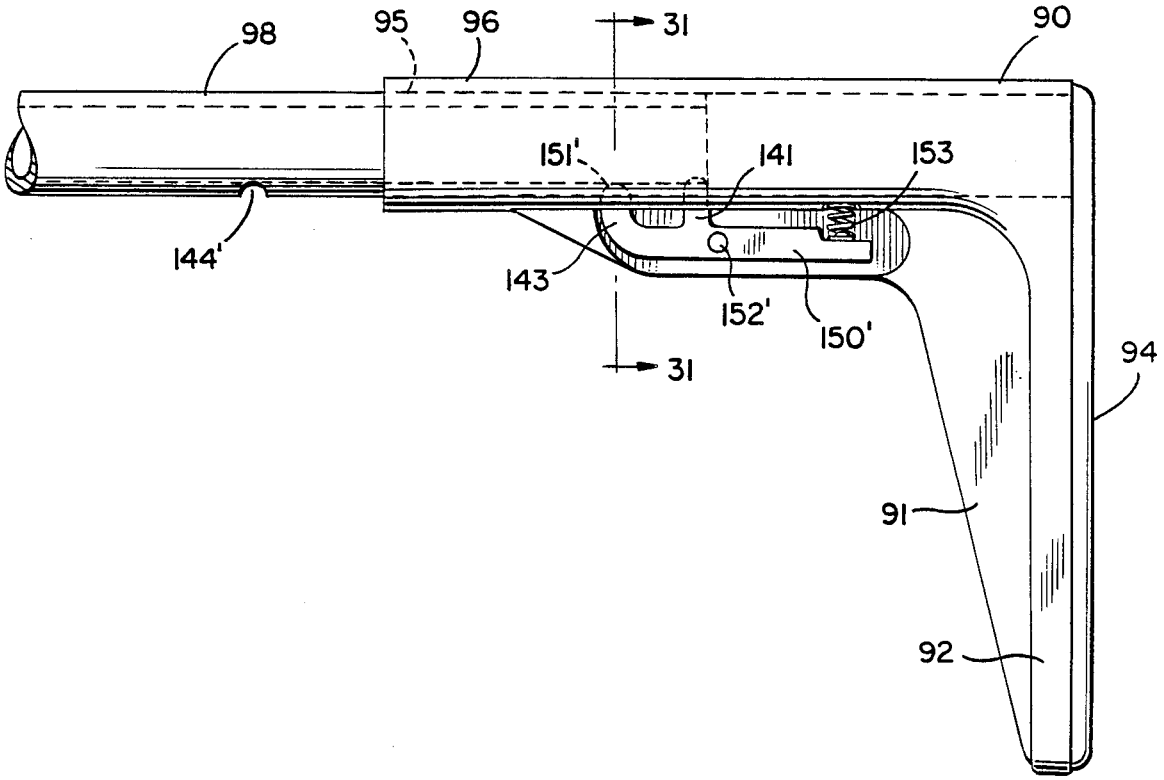
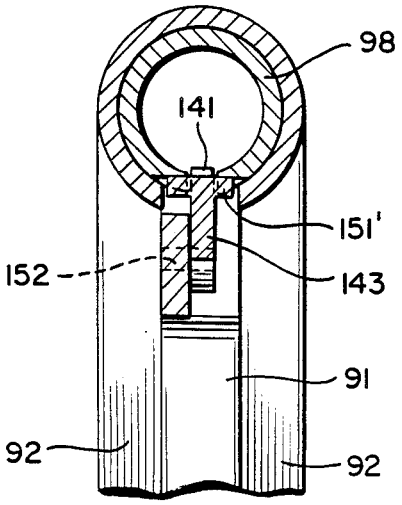
FIG. 31

GRIP AND STOCK ASSEMBLY FOR FACILITATING USE OF A COMPACT GUN

This application is a continuation-in-part of U.S. patent application Ser. No. 728,296 filed on Apr. 29, 1985, U.S. Pat. No. 4,640,036, which in turn is a continuation of U.S. patent application Ser. No. 448,828, filed Dec. 10, 1982 and issued as U.S. Pat. No. 4,513,523 on Apr. 30, 1985.

BACKGROUND OF THE INVENTION

1. Field of the Invention

This invention relates generally to a grip and stock assembly to facilitate use of a compact gun such as a carbine, submachine gun, machine pistol, or the like, and more specifically to an array of a pistol grip, a folding stock, and a handgrip arranged to optimize use of the gun in various firing and carrying positions. Also included is a new and more efficient cartridge magazine closure.

2. Description of the Prior Art

Many firearms, in general, and compact guns, in particular, have folding, retractable or detachable stocks, making them more portable and compact than firearms with rigidly fixed stocks. It is often necessary to hold a weapon in different ways depending on the desired handling or firing positions. Folding or retracting stocks improve handling and carrying characteristics when closed, yet after opening, enable aimed shoulder fire and aid in stabilizing a gun while firing bursts in various positions.

The stocks may be detachable whether solid, folding or retracting or pinned, bolted or otherwise secured to the rear of the weapon. Further, the firearm stocks may be made from wood, plastic, metal or other suitable composites with stamped, tubular and wire shapes often being used for prior art configurations Some detachable stocks—suitably shaped—serve also as holsters, while others are carried as a separate piece of equipment only. These separate pieces are attached to the gun only when needed.

In the case of retractable or folding stocks, many prior art configurations exist. One common type is the wire formed stock, which is rotatably or slidably mounted to the rear of the weapon. Another common type is the tubular or stamped telescoping stock, which is secured in various ways to the rear of the weapon. Still another common type is the tubular or stamped folding stock, of which many configurations exist, folding in different planes. Certain embodiments tend to partially obstruct the trigger portion or magazine catch of the weapon to be used requiring extension of the stock for operation of the gun.

Although the holster type or separate stock can provide a sturdy butt for shoulder firing, it is, nevertheless, cumbersome to carry as an auxiliary piece of equipment and also requires the use of otherwise precious time to secure it to the weapon. The stock often is also unnecessarily bulky when secured to the weapon.

While existing light and compact retractable stocks may be placed into active position relatively quickly, their construction does not provide a reliable and efficient stock and butt for use in both shoulder and underarm firing. Also, certain stocks, in order to be open and set, must be manipulated by both hands of the user, again wasting valuable time.

Under certain firing situations, it is necessary to grip the front portion of the compact gun with the left hand (in the case of a right-handed user), and, for this purpose, various hand guards and auxiliary grips are usually provided. Such guards and grips interfere with the provision of a coherent, integrated weapon by taking up space and protruding out the weapon proper. Folding auxiliary grips, on the other hand, add yet another component of the gun which must be taken care of.

Finally, when a compact gun is operated in an offhand pistol-like fashion, there is a tendency for the gun to jump causing the trigger hand to move relative to the forearm of the user and, thus, create an unsteady condition when aiming and firing.

In summary, prior art stocks show one or more of the following disadvantages:

A. Light and compact ones (wire or other forms) are flimsy and do not provide enough body for efficient support.

B. Sturdy stocks are either too heavy or too bulky when folded or retracted and do not integrate well into the gun.

C. None of the existing stock and grip arrays serves in aid of an efficient double handed grip when the weapon is fired with the stock folded.

There is, thus, a need for a grip and stock assembly which may be used in conjunction with a compact gun to provide an efficient way for gripping the weapon during various modes of operation while at the same time solving the problems enumerated hereinbefore; thus, ensuring a compact, integrated gun while it is being carried, yet providing a sturdy stock and gripping array when being fired. There is also a need for a more efficient cartridge magazine closure for use with the gun. The present invention is directed toward filling those needs.

SUMMARY OF THE INVENTION

The present invention relates to a grip and folding stock assembly mounted and arranged on a compact gun for facilitating use of the gun in various firing positions. Also forming part of the invention is an efficient cartridge magazine closure. For purposes of the present invention, the grip and folding stock assembly is employed with a weapon or gun that generally has an elongated receiver, a barrel mounted on the receiver, and front and rear sights mounted on the top of the receiver.

In a preferred embodiment of the subject invention, an L-shaped bracket, having horizontal and vertical legs, has the end of the horizontal leg secured to the distal end of a pistol grip emanating from the undersurface of the receiver, and the end of the vertical leg secured to the undersurface of the rearward end of the receiver. Mounted in this way, the bracket defines a receiving portion for the shooter's forearm to stabilize the gun while firing. This is accomplished when the vertical leg of the L-shaped bracket is pressed up against the forearm of the hand holding the pistol grip. For explanation purposes, it may be assumed that the shooter is right-handed. Thus, the vertical leg contains an indentation for receiving the thumb of the left hand of the user.

Also forming part of the subject invention is a folding stock, which is pivotally mounted to the rearward end of the receiver of the weapon. The stock is operative in several positions. In one position, the stock is folded and brought into close proximity to the bracket suitably shaped to, in effect, form one structure. While firing, the fingers of the left hand are wrapped around the portion of the right forearm opposite the point where the vertical leg is being pressed while the cup or palm of the left hand supports the horizontal portion of the folding stock. In another position, the stock is placed into a position suitable for shoulder firing. In still another position, the stock is placed into a position suitable for underarm firing where the butt of the stock presses up against the armpit of the user.

In one embodiment of the subject invention, the L-shaped bracket is eliminated and the folding stock is suitably configured to stabilize the gun in the manner previously discussed with regard to the forearm receiving position of the L-shaped bracket. In another embodiment, the folding stock is eliminated and only the bracket provides support and stabilization. In that case, the underside of the horizontal leg has a relatively wide surface to support the weapon in the palm of the left hand.

A trigger guard is provided just ahead of the pistol grip and completely surrounds and protects the trigger of the weapon. A handgrip forms part of the trigger guard. The handgrip performs the simultaneous functions of defining a portion of the trigger guard and providing a grip for holding the gun during firing.

Thus, it is a primary object of the subject invention to provide a grip and stock array for facilitating use of a weapon capable of being used in various firing positions.

It is another object of the present invention to provide a pistol grip and bracket assembly which cooperates with the hands of the user to stabilize the weapon during firing.

It is a further object of the present invention to provide a front handgrip which performs the dual functions of protecting a portion of the trigger and providing a grip for holding the gun during firing.

It is still an object of the present invention to provide a folding stock which is integrated into a gun and is sturdy and reliable when the stock is used in its fully retracted position with the gun being operated in a hand held mode or being carried.

It is yet another object of the present invention to provide a folding stock which is integrated into a gun and is sturdy and reliable when the stock is fully extended and the gun is being operated from the shoulder or underarm position.

It is still a further object of the present invention to provide an efficient cartridge magazine closure.

These and other objects and advantages will become more apparent when considered in conjunction with the following drawings and detailed description.

BRIEF DESCRIPTION OF THE DRAWINGS

FIG. 5 is a schematic illustration showing use of a gun embodying the subject invention in an off shoulder firing position.

FIG. 6 is a schematic illustration showing use of a gun embodying the subject invention in a shoulder firing position.

FIG. 7 is a schematic illustration showing use of a gun embodying the subject invention in a hand held firing position.

FIG. 8 is a schematic top view showing use of the gun presented in FIG. 7.

FIG. 19 is a side plane view of the rearward portion of the embodiment of the subject invention of FIG. 1 with the gun stock in several positions of intended use.

FIG. 20 is a top view of the swivel head for an alternative embodiment of the subject invention.

FIG. 21 is a view taken along lines 21—21 of FIG. 20.

FIG. 22 is a side view of one of the yokes for the swivel head of FIG. 20.

FIG. 23 is a detailed view of the protrusion on the yoke of FIG. 22.

FIG. 24 is a schematic illustration showing use of a gun embodying the subject invention in an underarm firing position.

FIG. 28 is a side view of the rearward portion of another embodiment of the gun stock assembly partially cut away to reveal an alternative detent arm structure.

FIG. 31 is a view taken along lines 31—31 of FIG. 28.

DETAILED DESCRIPTION OF THE DRAWINGS

Figure 1:
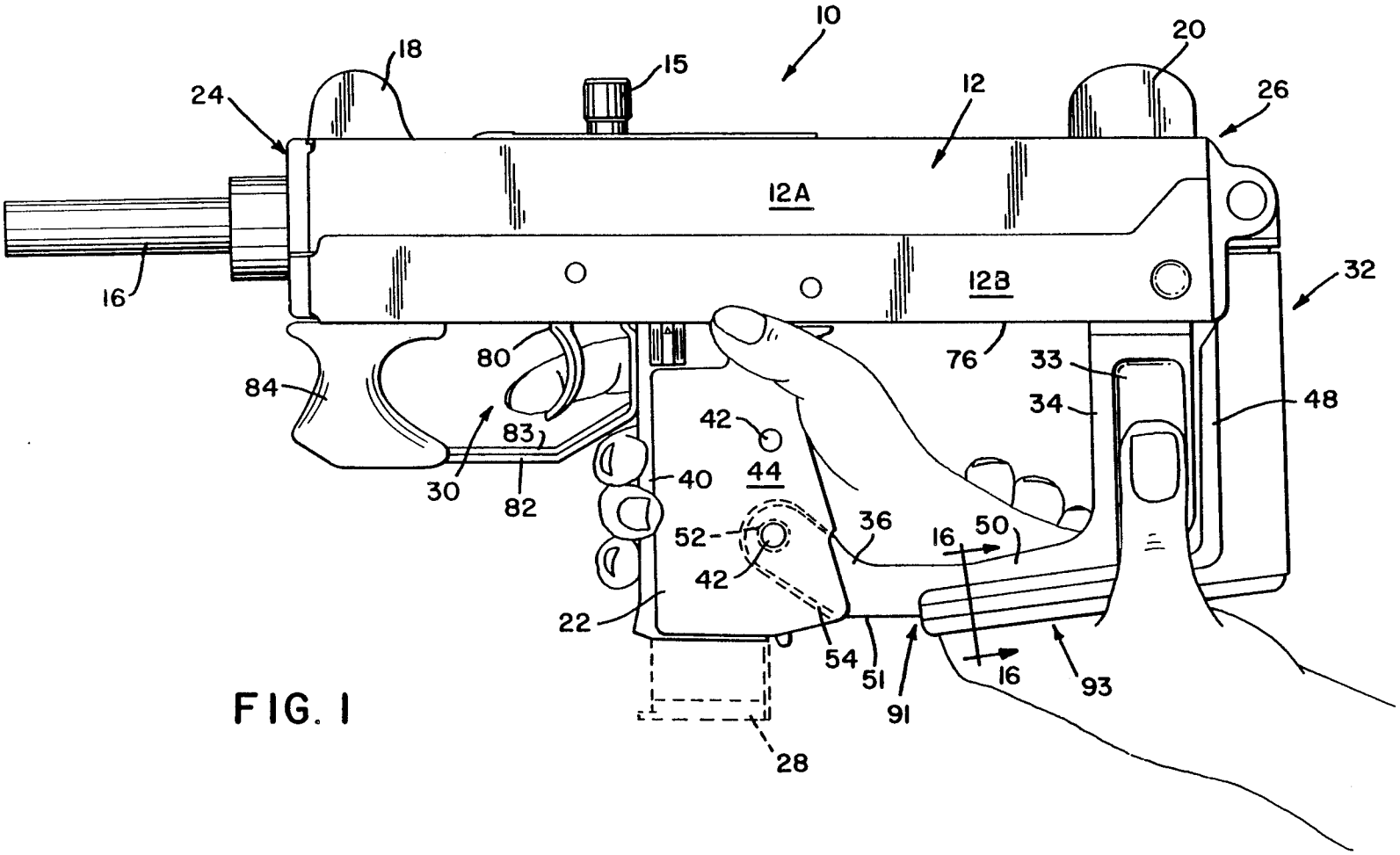
FIG. 1 is a side plan view of an embodiment of the subject invention with the gun stock in a folded position.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
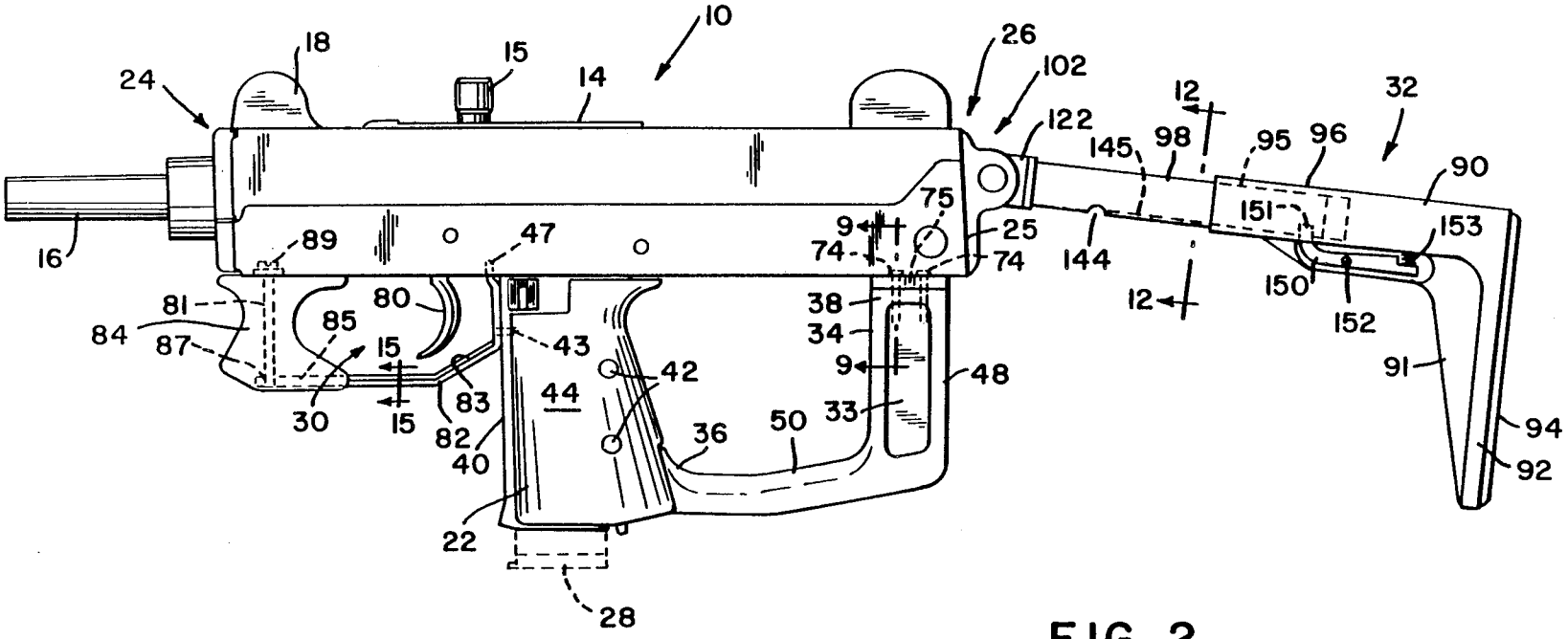
FIG. 2 is a side plan view of the embodiment of the subject invention of FIG. 1 with the gun stock in a fully open position and partially cut away to reveal the detent arm structure.

FIGS. 1 and 2 generally illustrate the grip and folding stock assembly mounted and arranged on a compact gun in accordance with the teachings of the subject invention.

The body of a gun suitable for practicing the subject invention is shown generally at 10, and, because the workings of the gun do not form part of the invention, is illustrated in its overall configuration, the general features of which are well known to persons skilled in the art and will not, therefore, be described in detail. One such compact gun which can be adapted to make use of the teachings of the present invention is one embodying the general principles and characteristics of the 9 mm. UZI submachine gun.

For purposes of explaining the teachings of the present invention, the weapon 10 generally has an elongated receiver 12, a cocking knob 15, a barrel 16 mounted in the receiver, and front and rear sights 18 and 20 mounted on the top of the receiver. In the embodiment shown in FIG. 1, the receiver is divided into an upper receiver 12A that houses a bolt mechanism and a lower receiver 12B that houses a trigger mechanism. Having discussed the general characteristics of a compact gun suitable for employing the teachings of the subject invention, the grip, stock and magazine arrangement constituting the present invention will now be described.

With reference to its orientation in FIG. 1, a pistol grip 22 extends downwardly from the lower receiver 12B at a location approximately midway between the forward and rearward ends 24 and 26 of the receiver. The pistol grip forms a housing for a cartridge magazine or clip 28 including a specific embodiment to be described in greater detail hereinafter. A trigger area, generally designated as 30, is positioned forwardly of the pistol grip 22 downwardly from the trigger mechanism (not shown) housed in the lower receiver 12B. A folding stock 32 is pivotally secured to the rear portion 26 of the weapon 10. In its folded position, the stock mates with a generally L-shaped bracket or member 34 that has one end 36 secured to the pistol grip and the other end 38 secured to the underside of the weapon.

Figure 3:
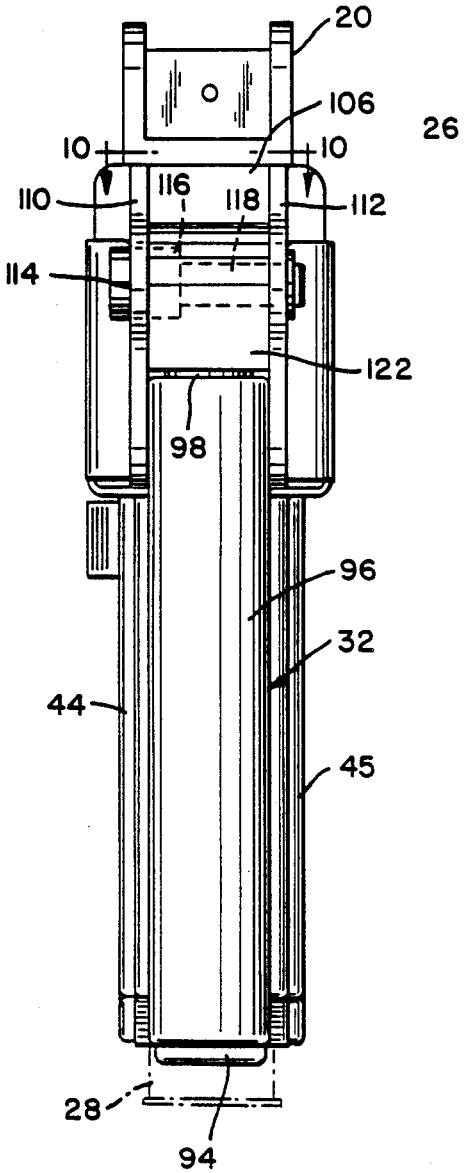
FIG. 3 is a back plan view of the embodiment of FIG. 1 with the stock folded.
Figure 4:
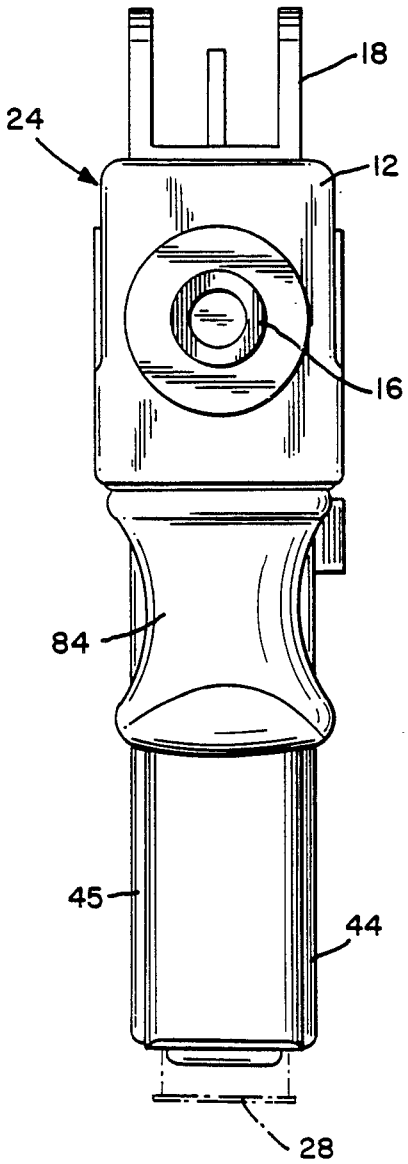
FIG. 4 is a front plan view of the embodiment of FIG. 1.

The pistol grip 22 in cooperation with the L-shaped bracket 34 provides a structure that ensures stable firing when the weapon is employed as a pistol with the stock 32 in the folded position. The pistol grip 22 includes a magazine housing 40 secured as by welding or otherwise fastened to the lower receiver 12B. The housing 40 has an interior configuration sized and shaped to receive the magazine 28. Secured to the housing 40 by conventional fastening means, such as screws or bolts 42, is a pair of complementary grip panels 44 and 45 (FIGS. 1 and 3).

Figure 9:
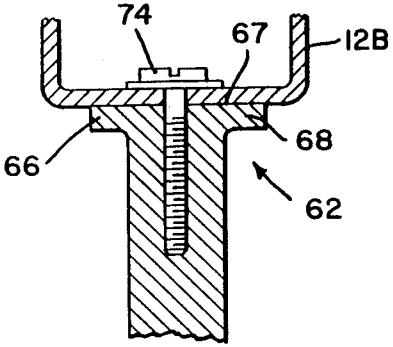
FIG. 9 is a view taken along line 9—9 of FIG. 2.

The L-shaped bracket 34 is preferably made of a light material such as aluminum or plastic to cut down on weight. As oriented in FIG. 2, the L-shaped bracket 34 has a generally vertically extending leg 48 and a generally horizontally extending leg 50. The vertically extending leg 48 includes an elongated indentation, 33 and 35, defined on each side of the bracket 34. The end 36 of leg 50 is secured to the pistol grip in the following manner. The end 36 of leg 50 terminates in an aperture 52. The pair of panels 44 and 45 are mounted in such a way that, in cooperation with the housing 40, they create an evacuated portion 54 within the pistol grip to receive the end 36 of leg 50. The aperture 52 receives screw 42 in order to fixedly mount the end 36 of leg 50. The other leg 48 of the L-shaped member 44 has at its end 38 a T-shaped portion 62. As oriented in FIGS. 2 and 9, the end 38 of leg 48 contains left and right side extensions 66 and 68, which define a broad base 67 for stabilization against the underside 76 of the lower receiver 12B. Two spaced screws 74 are provided from within lower receiver 12B for securing the leg 48 to the underside 76 of the body of the weapon 10. One or more registration pins or protrusions 75 may be included with the screws. In this way, the end 38 of the leg 48 is positioned on the underside 76 of the weapon at the rearward portion 26 of the receiver 12. It is understood that the grip and bracket may be molded as one piece.

In a preferred embodiment, the pistol grip 22 is located on the underside 76 of the lower receiver 12B of the weapon with its longitudinal axis intersecting the longitudinal axis of the elongated receiver 12 of the weapon 10. Further, the longitudinal axis of the pistol grip is approximately at the midpoint of the receiver 12. As can be appreciated from FIG. 1, should the size of the receiver be elongated in a forward or backward direction, then the pistol grip would not be located at the midpoint of the receiver. It is to be further understood that, depending on how the interior mechanism is constructed, the position of the pistol grip 22 may be shifted fore or aft of the midpoint of the receiver.

The triggering area 30 basically comprises a trigger 80 surrounded by a trigger guard 82. Forming the forward end of the trigger guard is a handgrip 84 configured to accommodate the thumb and one or two fingers of the hand of a user.

Figure 15:
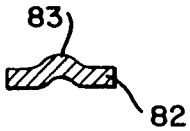
FIG. 15 is a view taken along lines 15—15 of FIG. 2.

As best seen in FIGS. 1, 2 and 15, the trigger guard 82 consists of a flat metal strip having a reinforcing indentation 83 throughout its length. The trigger guard is appropriately bent to have one end 47 positioned in an aperture found on the underside of the receiver 12. At the same time, the trigger guard 82 has a protrusion 43 that is placed into a fitted aperture defined in the magazine housing 40. The other end 85 of the trigger guard terminates in an aperture 87. A screw 81 is placed through the aperture 87 through a bore provided in the handgrip 84 and then into the lower receiver 12B. The threaded end of the screw receives an appropriate nut 89 positioned within the receiver. In this way, the handgrip is firmly secured to the underside of the receiver and also completes the connection with the trigger guard 82.

The details of how the trigger 80 activates the internal workings of the weapon do not form part of the invention and, therefore, will not be discussed in detail.

Figure 12:
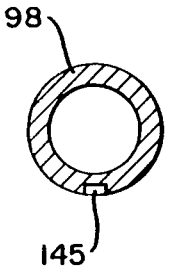
FIG. 12 is a view taken along lines 12—12 of FIG. 2.

With reference to FIGS. 1, 2 and 12, the folding stock 32 basically comprises a generally L-shaped shoulder bracket 90 having one leg 92 defining a butt or end 94 which is placed against the shoulder of a user when the weapon is used for shoulder firing. The shoulder bracket 90 contains a second leg 96. Defined within the leg 96 is a longitudinally extending bore 95 which is sized to slidably receive a tubular member 98. It is to be understood that the cross section of both the bore 95 and the member 98 may be other shapes, for example, square, it being the primary objective to minimize relative turning as the member 98 slides within the bore 95. In the case of the tubular member 98, relative turning is prevented through the use of a longitudinal groove 145 provided in member 98 which cooperates with a projection 151 on a detent arm 150 which acts as a guide pin in a manner to be described in greater detail hereinafter.

One end 102 of tubular member 98 terminates in a pivot assembly 104 that is secured to the back end 25 of the rearward portion 26 of the weapon receiver 12. The pivot assembly 104 includes a mounting plate 106 that contains a generally planar portion 108 which is placed into contact with the rearward portion 26 of the weapon body 10. Emanating from the plate 106 in a generally rearward direction is a pair of spaced parallel yokes 110 and 112. Movably mounted within the apertures defined in each of the yokes is a pivot pin 114. As viewed in FIGS. 10*a* and 10*b*, the pivot pin is divided into two basic portions: a first body portion of enlarged diameter 116 and a second body portion 118 of narrower diameter. The body portion 116 at the point where it enters the aperture defined in the yoke 110 contains a protrusion 120.

The end 102 of tubular member 98 contains a swivel head 122 which completes the pivot assembly 104. Head 122 terminates in a generally cylindrical portion having a bore so that the swivel head may be pivotally mounted to the pivot pin 114. The side of the swivel head 122 which comes into contact with the protrusion 120 is configured to provide an elongated indentation or channel 115 within which a portion of protrusion 120 is always found. The exposed end of the large body portion 116 defines an activation button 111. A spring 113 constantly urges the button 111 in an outward direction. A lock washer 121 is secured to the end of reduced portion 118 to prevent ejection of the pivot pin 114 from between the yokes. Appropriately defined within the yoke 110 are a pair of spaced indentations 140 and 142, which are positioned in such a way that they lock the stock into its folded position in close contact with the L-shaped bracket 34 or in its fully opened position for use in shoulder or underarm firing.

With reference to FIGS. 1, 2, 10*a* and 11, the way in which the stock 32 is moved from its folded to its open position will now be presented. As oriented in FIG. 1, the stock is in its folded position. As such, the protrusion 120 is positioned within recess 140 under the urging of spring 113. In order to pivot the stock to its open position, as shown in FIG. 2, the button 111 is depressed to cause the protrusion to completely enter the channel 115 defined in the swivel head 122. With the protrusion removed from indentation 40, the swivel head is then free to pivot about pin 114 until the protrusion enters indentation 142 defined on the yoke as the pivot pin 114 is urged in that direction by the spring 113.

In order to facilitate going from the folded to the open stock position, the indentation 140 may be chamfered, thus, providing for easy release of the protrusion 120. In fact, the chamfer may be such that it is not necessary to activate the button 111 in order to permit pivoting of the swivel head. At the same time, it is necessary to positively lock the stock when it is used in its open position. For this reason, the indentation 142 has a more precise mating configuration with the protrusion 120.

Figure 10B:
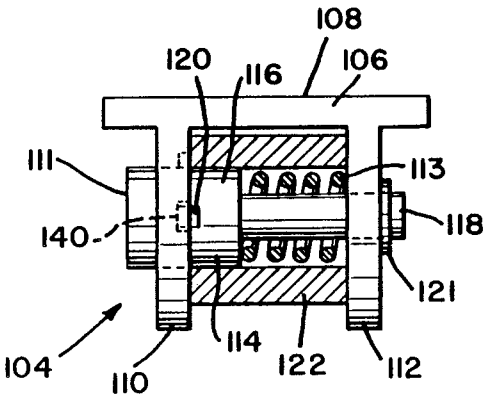
FIG. 10*b* is the same view of FIG. 10*a* with the top portion of the swivel head removed.
Figure 11:
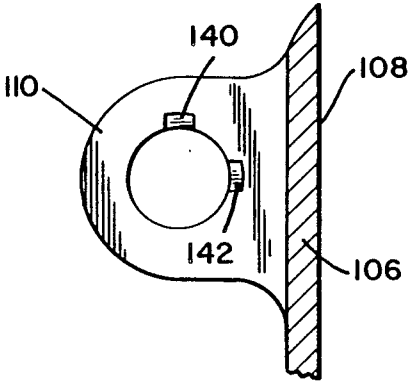
FIG. 11 is a view taken along lines 11—11 of FIG. 10*a*.
Figure 18:
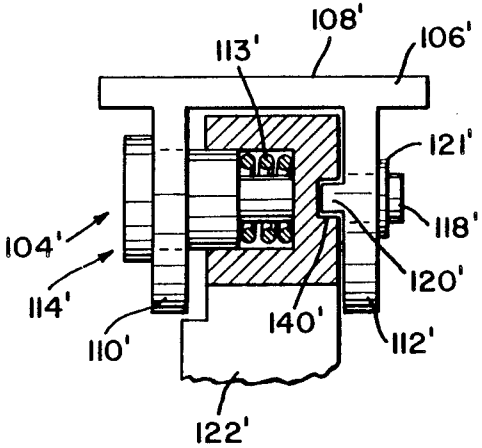
FIG. 18 is a top view partially cut away of an alternative embodiment of the pivot assembly.
Figure 10A:
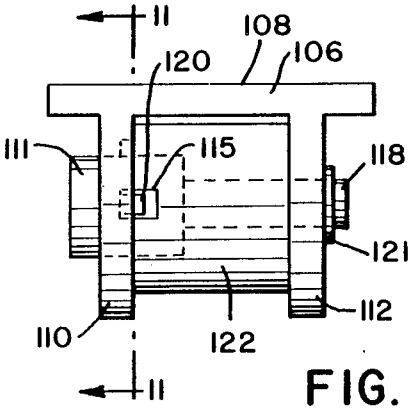
FIG. 10*a* is a view taken along lines 10—10 of FIG. 3.

FIG. 18 generally illustrates an alternative embodiment of the pivot assembly 104 where primed reference numerals denote elements similar to the embodiment of FIG. 10*b*. Mounting plate 106' contains a generally planar portion 108' which is placed into contact with the rearward portion 26 of the weapon body 10. Emanating from the plate 106' in a generally rearwardly direction is a pair of spaced parallel yokes 110' and 112'. Fixedly mounted within apertures defined in each of the yokes is a pivot pin 114'. As viewed in FIG. 18, the pivot pin is divided into two basic portions: a first body portion of enlarged diameter 116' and a second body portion 118' of narrower diameter.

The end 102 of tubular member 98 contains a swivel head 122' which completes the pivot assembly 104'. Head 122' terminates in a generally cylindrical portion having a longitudinal bore so that the swivel head may be pivotally mounted to the pivot pin 114'. The side of the swivel head 122' which comes into contact with a protrusion 120' formed in yoke 112' is configured to provide a pair of spaced indentations 140' and 142' which are positioned in a manner to be described hereinafter. The exposed end of the large body portion 116' is fixed against longitudinal movement. A spring 113' constantly urges the channel 140' onto protrusion 120'. A lock washer 121' is secured to the end of reduced portion 118' to further prevent longitudinal movement of the pivot pin 114'. The pair of spaced indentations 140' and 142' are positioned on the swivel head in a manner similar to the indentations 140 and 142 found on yoke 110 of the first embodiment so that they lock the stock into its folded position in close contact with the L-shaped bracket 34 or in its fully open position for use in shoulder or underarm firing. Rotating the stock in one direction is accomplished by disengaging channel 140' from protrusion 120' and rotating the stock so that channel 142' is biased onto protrusion 120' by spring 113'. Rotating the stock in the other direction is accomplished by reversing the procedure.

Figure 16:
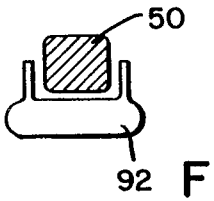
FIG. 16 is a view taken along lines 16—16 of FIG. 1.

Positioned about the interior portion 91 of the shoulder bracket 90 is a recess which generally mates with complementary structure provided about the outer surface 51 of the L-shaped member 34 so that the shoulder member 90 may be supported by the L-shaped member 34. As can be seen in FIGS. 1 and 16, support of the shoulder member 90 by the L-shaped member 34 takes place at the lowest portion 93 of the shoulder member, but may also take place at any part of the vertical leg.

The tubular member 98 contains two cutouts 144 and 146 which are spaced from each other along a longitudinally extending groove 145 that accommodates the projection 151 of detent arm 150 pivotally mounted to the hinge portion by pivot pin 152 and biased by spring 153. The groove 145 in cooperation with the projection of the detent arm 150 provides a convenient way to prevent relative turning of the tubular member 98 as it slides in the bore 95. In use, the shoulder portion may be locked into a fully retracted position when the detent is positioned within aperture 144 or in a fully extended position when the projection of the detent arm is placed into aperture 146.

FIGS. 28 and 31 illustrate yet another embodiment for the detent arm assembly. As such, like reference numerals denote like elements and primed reference numerals deoote similar elements for the embodiment just described. In the embodiment shown in FIGS. 28 and 31, the tubular member 98 contains two cutouts 144 and 146 which are spaced from each other along a longitudinally extending slit 145' that accommodates the projection 141 of detent arm 150' pivotally mounted to the hinge portion by pivot pin 152 and biased by spring 153. The slit 145' in cooperation with the projection 141 of the detent arm 150' provides a convenient way to prevent relative turning of the tubular member 98 as it slides in the bore 95. In use, the shoulder portion may be locked into a fully retracted position when the detent 151' located at the forward portion of arm 150' is positioned within aperture 144 or in a fully extended position when the projection of the detent arm is placed into aperture 146.

FIGS. 19 through 24 illustrate yet another embodiment of the pivot assembly 104' where primed reference numerals denote elements similar to the embodiment of FIG. 18. Mounting plate 106' contains a generally planar portion 108' which is placed into contact with the rearward portion 26 of the weapon body 10. Emanating from the plate 106' in a generally rearwardly direction is a pair of spaced parallel yokes 110' and 112'. Fixedly mounted within apertures defined in each of the yokes is a pivot pin 114'. As viewed in FIG. 21, the pivot pin is divided into two basic portions: a first body portion of enlarged diameter 116' and a second body portion 118' of narrower diameter.

The end 102 of tubular member 98 contains a swivel head 122' which completes the pivot assembly 104'. Head 122' terminates in a generally cylindrical portion having a longitudinal bore so that the swivel head may be pivotally mounted to the pivot pin 114'. The side of the swivel head 122' which comes into contact with a protrusion 120' formed in yoke 112' is configured to provide a pair of spaced grooves or channels 140' and 142' which are positioned in a manner to be described hereinafter. The exposed end of the large body portion 116' is fixed against longitudinal movement. A spring 113' constantly urges the channel 140' onto two protrusions 120'. A lock washer 121' is secured to the end of reduced portion 118' to further prevent longitudinal movement of the pivot pin 114'. The pair of spaced channels 140' and 142' are positioned on the swivel head at a predetermined radial angle relative to each other. Channel 140' is positioned on the side 131' of swivel head 122' so that the stock 32 assumes the position shown in FIG. 19 when the channel 140' mates with protrusion 120'. Channel 142' is positioned on the side 131' to perform the dual function of either locking the stock into its folded position in close contact with the L-shaped bracket 34 or in a fully extended position for use in underarm firing with the butt end of the stock contacting the armpit of the user as shown in FIG. 24. Rotating the stock in either direction is accomplished by disengaging channel 140' from protrusion 120' and rotating the stock so that channel 142' is biased onto protrusion 120' by spring 113'. Rotating the stock in the opposite desired direction is accomplished by reversing the procedure.

Having described the details of the grip and stock assembly, the advantages obtained during the use of the weapon will now be described.

If it is desired to use the weapon in a pistol configuration, then the folding stock 32 is in a fully folded and retracted position, such as that shown in FIG. 1. Thus, used in traditional semiautomatic or fully automatic mode, the pistol grip 22 of the weapon is grasped in a well known manner with the trigger finger of, for example, the right hand appropriately placed on the trigger 80. A cocking knob 15 may be set with the left hand in order to prepare the weapon for firing. The left hand is then moved into position behind the right hand. The thumb of the left hand is pressed into indentation 33 to drive vertical leg 48 against the right forearm. At the same time, the fingers of the left hand are wrapped around the underside of the right forearm while the palm of the hand supports the butt 94 which is in contact with the horizontal leg 50. In this way, the jump of the weapon normally found in prior art configurations is greatly reduced. In essence, at least two points of stabilization are provided when the gun is held by the two hands in the firing position shown in FIG. 1. One point of stabilization is created where the right hand grasps the pistol grip 22. The other point of stabilization is created where the left hand performs the dual functions of gripping the right forearm to secure the vertical leg 48 against the right forearm and providing lower support for the horizontal leg 50 and butt 94 in the palm of the hand.

If it is desired to use the pistol in an underarm or hip position with the stock open or closed, such as shown in FIG. 5, the pistol grip and trigger are grasped in the same manner as for a traditional pistol with the leg 48 of the L-shaped bracket 34 resting against the bottom portion of the forearm which lies in the same plane as the fleshy part of the hand. At the same time, the handgrip 84 receives the thumb and one or two fingers of the other hand of the user. In this way, a very sturdy gripping arrangement is provided. Thus, the handgrip 84 provides a convenient and efficient way in which the user may grip the front of the weapon to further steady the gun during automatic firing. In particular, the position of the handgrip 84 relative to the pistol grip 22 orients the left arm so that it may be pressed against the side of the body of the shooter for added support.

When the weapon is to be fired from the shoulder, the stock is unfolded and rotated about pivot pin 114 until the protrusion 120 is received within the indentation 142 defined within the yoke 110. When this point is reached, the folding stock will be locked into the position shown in FIG. 2. Simultaneously with the unfolding motion, the butt 94 of the folding stock 32 is grasped and pulled away from the weapon causing the projection 151 of the detent arm 150 to be removed from aperture 144 and to assume its new place within aperture 146, thus, locking the butt relative to tubular member 98. In this configuration, the weapon may be used in a traditional rifle configuration for shoulder or underarm firing. See, for example FIG. 6.

If it is desired to use the gun in an underarm position with the butt of the stock placed against the armpit of the user, such as shown in FIG. 24, the pistol grip and trigger are grasped in the same manner as for a traditional pistol with the leg 48 of the L-shaped bracket 34 resting against the bottom portion of the forearm which lies in the same plane as the fleshy part of the hand. It is contemplated to also grip the handgrip 84 with the left hand.

The stock is unfolded and rotated about pivot pin 114' until the protrusions 120' are received within each end of channel 142' defined within the swivel head 122' so that the tubular member 98 extends upwardly and generally is perpendicular to the longitudinal axis of receiver 12. When this point is reached, the tubular member 98 of the folding stock will be locked into the position shown in FIG. 24. Either before or after unfolding the stock, the butt 94 of the folding stock 32 is grasped and pulled away from the weapon causing the projection 151 of the detent arm 150 to be removed from aperture 144 and to assume its new place within aperture 146, thus, locking the butt relative to the tubular member 98. In this configuration, the weapon may be used in an unorthodox rifle configuration for underarm firing where the butt 94 presses against the armpit of the user for stability. If the user desire to fire the gun with the arm at a higher elevation than shown in FIG. 24, the shoulder bracket 90 may be used in a compressed configuration with tubular member 98 retracted into bracket 90 and projection 151 in cutout 144.

Figure 13:
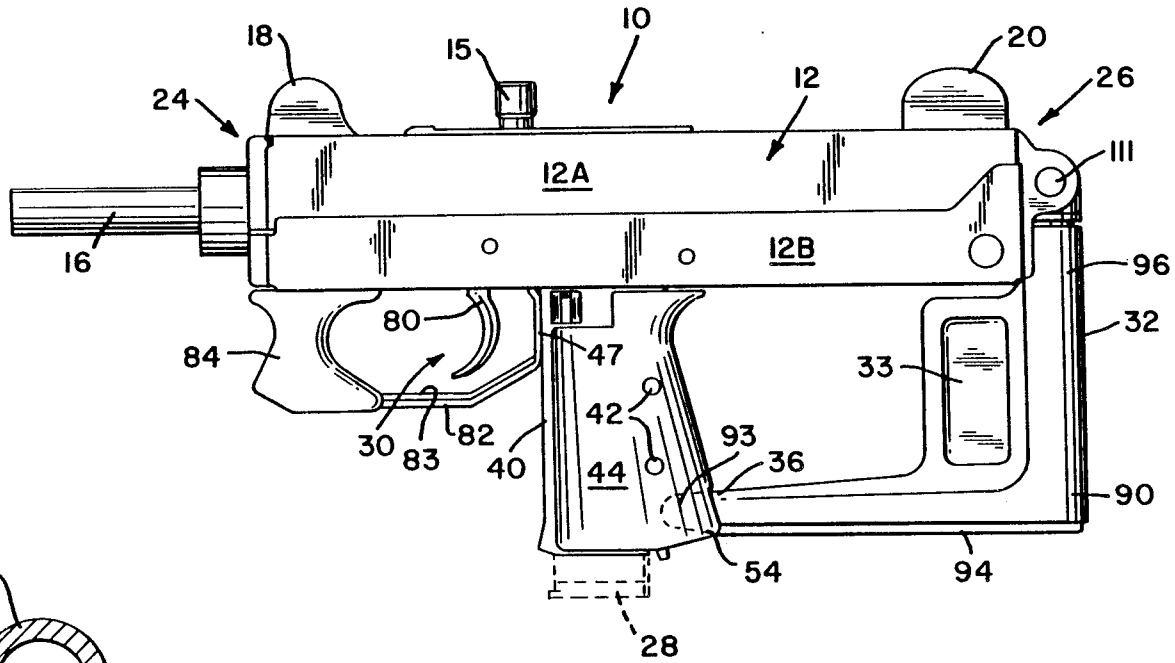
FIG. 13 is a side plan view showing a further embodiment of the subject invention employing the folding stock only.

In the embodiment of the subject invention as shown in FIG. 13, the L-shaped bracket 34 has been eliminated with leg 96 appropriately changed to include thumb receiving area 33. In place of 34 the shoulder bracket 90 at the free end 93 defined at the end of the shoulder butt 94 contains a projection mating with complementary structure defined in the evacuated portion 54 of the pistol grip 22.

With this arrangement, when the folding stock is fully folded so that the free end of the folding stock is mated to the pistol grip, the leg 96 of the shoulder bracket 90 performs the function previously carried out by the vertical extending leg 48 of the L-shaped bracket 34. In this way, when using the weapon as a pistol, the leg 96 is pressed up against the forearm of the trigger hand to steady the weapon during firing while the butt is cupped or supported by the hand. The end 36 of butt 94 may also be free standing and not mate with aperture 54.

Figure 14:
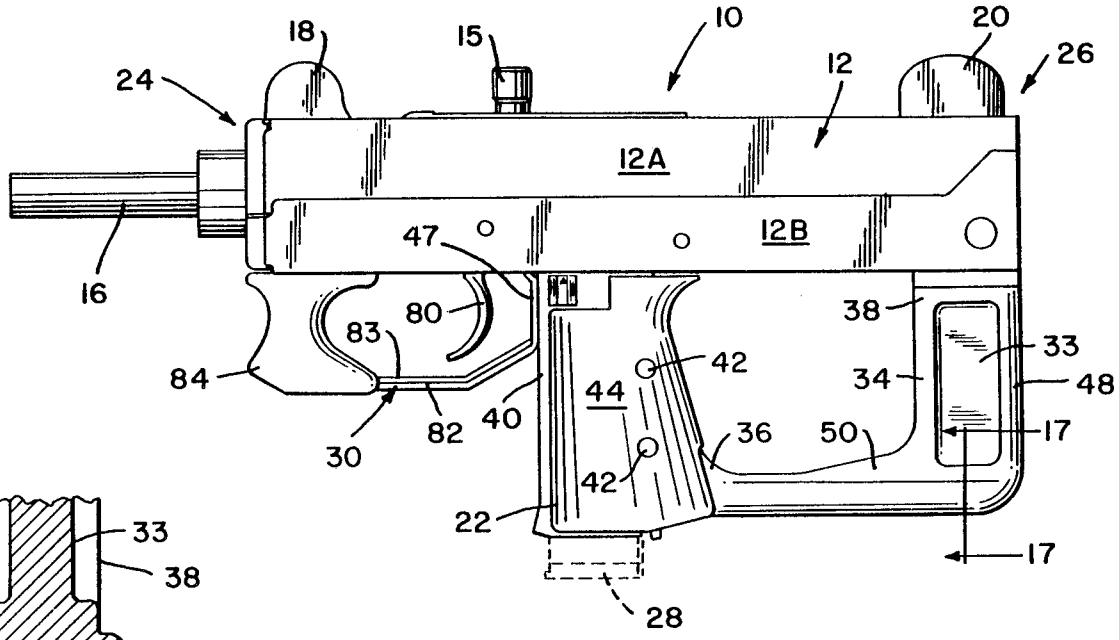
FIG. 14 is a side plan view showing yet another embodiment of the subject invention employing the L-shaped bracket only.
Figure 17:
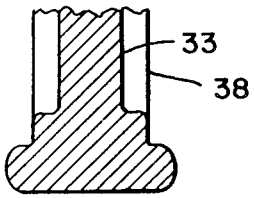
FIG. 17 is a view taken along lines 17—17 of FIG. 14.

In yet a further embodiment, as shown in FIG. 14, stock 32 has been removed, leaving only the L-shaped bracket 34. With this arrangement, the gun may be used as shown in FIG. 1 with the palm of the left hand now supporting the bottom of the horizontal leg 50 in the gripping arrangement. In all other respects, the operation of the weapon is the same as that described with regard to the embodiment shown in FIG. 1. Leg 50 may be shaped as shown in FIG. 17 to provide a wide support base for the palm of the user.

Figure 29:
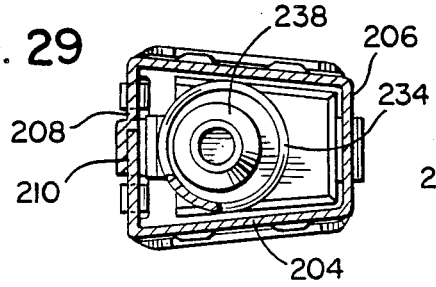
FIG. 29 is a view taken along lines 29—29 of FIG. 27.

FIGS. 25–27, 19 and 30 illustrate a preferred embodiment of the cartridge magazine, generally designated as 28. The magazine basically comprises an elongated hollow housing 200 made up of two side walls 202 and 204, a forward wall 206 and a rearward wall 208. The hollow housing may be formed by any of the conventional methods and materials known for making magazines. As shown in FIG. 29, a cross-sectional view of the walls forming the cartridge housing is generally wedge-shaped with the rearward wall 208 being of greater width than the forward wall 206. Additionally, the rearward wall 208 contains an indentation 207 for latching the magazine into the pistol grip 40 in a conventional manner.

Figure 25:
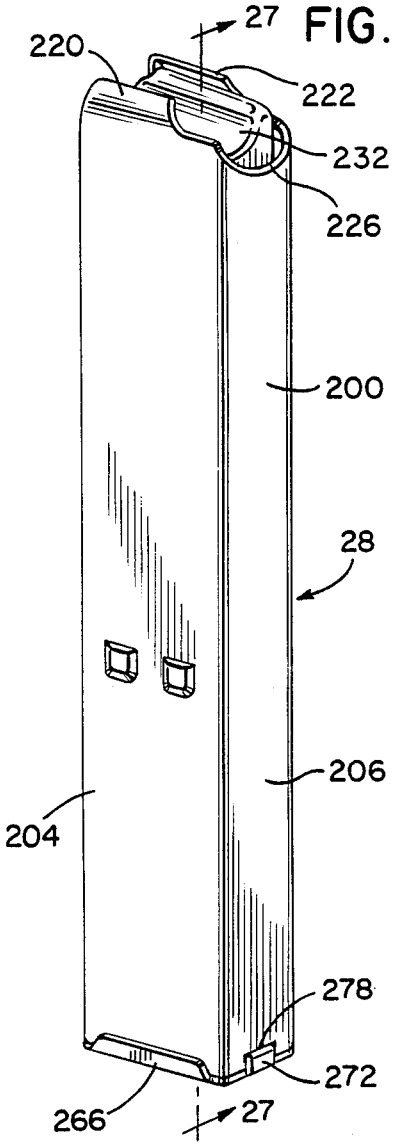
FIG. 25 is a perspective view of a magazine embodying the teachings of the subject invention.
Figure 26:
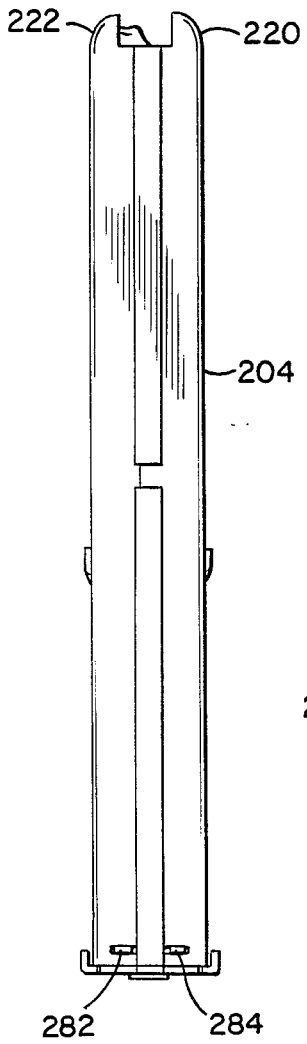
FIG. 26 is a rear view of the magazine of FIG. 25.
Figure 27:
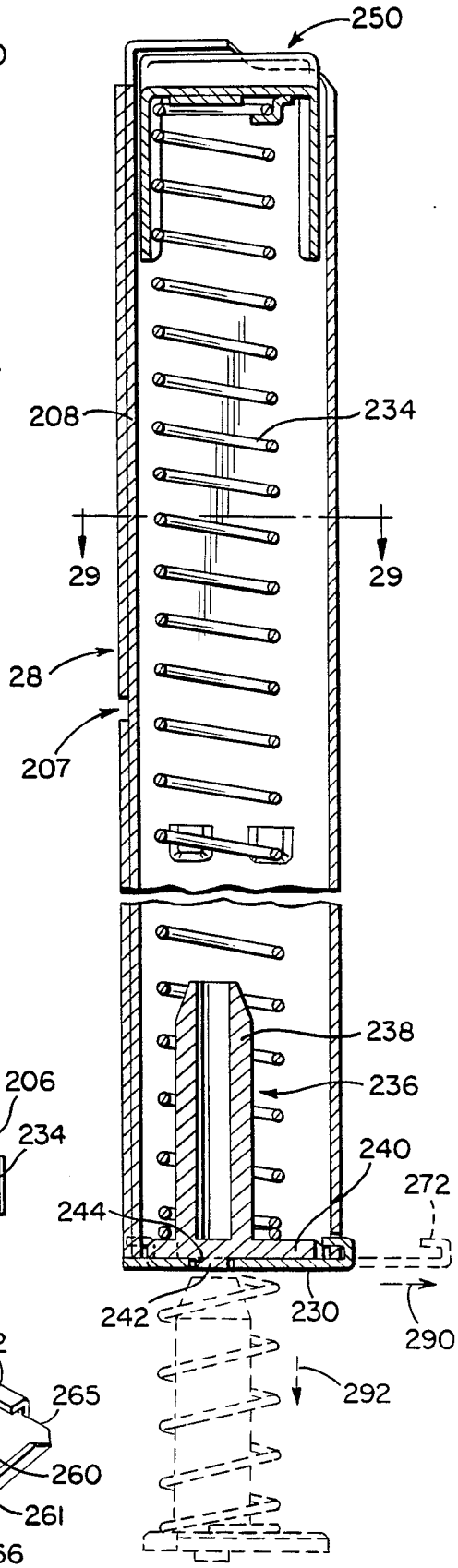
FIG. 27 is a view taken along lines 27—27 of FIG. 25.

The top of the magazine as oriented in FIG. 25 terminates in two inwardly projecting curved finger portions 220 and 222. At the rear of these curved portions is a generally rectangular cutout 224 defined in wall 208 (FIG. 26). The forward portions of fingers 220 and 222 blend with a generally curved shaped cutout 226 defined at the top and forward portion of sidewalls 202 and 204 and the top and forward wall 206. Together these elements define a conventional opening for loading and striping cartridges.

Located at the bottom of the casing 28 is a generally planar cap 230. As will be explained in greater detail hereinafter, the cap is removably secured to cover the bottom opening of the casing. Positioned within the hollow interior of the casing is a magazine follower 232, a compression spring 234 and a spring guide member 236. The guide member basically comprises an elongated hollow cylindrical portion 238 which is supported on a base 240. In use, the bottom surface of the base is in intimate contact with the cap 230. A projection 242 mates with an aperture 244 defined in the cap in order to place the guide member in register with the cap and to prevent the cap from moving relative to the housing 200. One end of spring 234 is disposed about cylindrical portion 238. This end of the spring presses up against the flat portion of base 240. The other end of the spring presses up against the interior surface of the magazine follower 232 in order to urge cartridges, positioned within the magazine, in the direction of the cartridge ejection opening 250.

Figure 30:
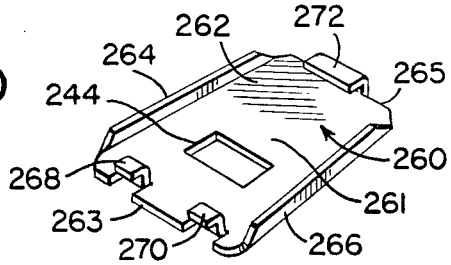
FIG. 30 is a perspective view of the planar cap of FIG. 27.

The way in which the cap 230 is removably secured to the bottom of the hollow housing 200, will now be described. With reference to FIG. 30, the cap 230 generally comprises a planar area 260 of generally wedge shape. As oriented in FIG. 30, the planar area defines a wedge-shaped top surface 262. At either side of the top surface are upwardly extending lip portions 264 and 266. Near the widest part 263 of the wedge, the cap defines two upwardly projecting hook portions 268 and 270. These hooks are arranged so that they face in an outward direction, away from the central surface of the planar cap. The ends of the hooks may or may not protrude beyond the periphery of the widest part of the wedge. Along the narrowest portion 265 of the cap, an upwardly extending hook 272 appears and extends in a direction toward the central surface of the cap. Thus, hooks 268, 270 and 272 all face in the same direction. With reference to FIG. 26, the rearward wall 208 near its bottom periphery contains a pair of slots 282 and 284. These slots are sized and positioned to receive hooks 268 and 270 when the cap is placed in contact with the rim 276 at the bottom of the housing. In like manner, the front wall 206 of the housing contains slot 278 which receives hook 272. In order to secure the cap to the underside of the magazine housing, the interior surface 262 of the cap is placed up against the rim 276 near the narrowest portion of the wedge. The cap is then slid toward the widest portion of the wedge until the hooks 268, 270 and 272 simultaneously engage their respective slots 282, 284 and 278. When this occurs the protrusion 242 will be pressed into the aperture 244 and thus securely lock the cap in place through placement of base 240.

In order to remove the cap for dissassembly of the magazine, the protrusion 242 must be dislodged from the aperture 244 by urging the protrusion toward the top of the magazine. Simultaneously, the bottom cap is slid in the direction shown in FIG. 27 by arrow 290. When the cap has been removed, the compression spring extends in the direction shown by arrow 292 to force the bottom portion out of the housing. When the spring is relaxed, it may be removed with the magazine follower.

The way in which the bottom cap is removably secured to the bottom of the magazine, provides several distinct advantages over the prior art. In particular, the slot area where the hooked fingers engage the bottom of the cartridge casing are protected because the slots do not protrude as is common in some prior art configurations. In addition, cartridge magazine 28 is easy to assemble because the attachment of the bottom cap requires a one direction motion as opposed to the two direction motion found in one prior art example. Further, the construction of the floor plate with the upwardly extending sides 264 and 266, acts to protect the bottom of the magazine.

Although the present invention has been shown and described in terms of a specific preferred embodiment, it will be appreciated by those skilled in the art that changes or modifications are possible which do not depart from the inventive concepts described and taught herein. Some of the parts of the gun, for example the lower receiver, the front grip 84, the pistol grip 84, the pistol grip 22 and the bracket, may selectively be made of unitary construction. Such changes and modifications are deemed to fall within the purview of these inventive concepts.

What is claimed is:

1. An apparatus for use with a gun having an elongted receiver including a forward end, a rearward end and an undersurface, said apparatus comprising:

a pistol grip emanating outwardly from said undersurface away from said receiver; and stock means including a stock terminating in a butt pivotally mounted to a portion of said receiver behind said pistol grip, said stock means operative between three extreme positions, a first position where said stock means is in close proximity to said pistol grip, a second position where said stock means is placed into a position suitable for shoulder firing, and a third position where said stock means is placed into position where the butt of the stock presses up against the armpit of the user, said stock means in said first position being adapted to stabilize said gun while firing by pressing up against the forearm of the hand of the user holding said pistol grip.

2. The apparatus of claim 1, wherein said stock means comprises:

a generally L-shaped member with one leg defining a butt;

an elongated member cooperative in a telescoping relationship with the other leg of said L-shaped member; and pivot means for pivotally connecting the distal end of said elongated member to the rearward end of said elongated receiver.

3. The apparatus of claim 1, wherein said stock means comprises:

a generally L-shaped member with one leg of the member defining a butt and the other leg of said member defining a longitudinally extending bore;

an elongated tubular member slidably mounted in said bore; and pivot means for pivotally connecting the distal end of said tubular member to the rearward end of said elongated receiver.

4. The apparatus of claim 3, further comprising detent means mounted in said L-shaped member for locking said tubular member into either of two different positions within said bore of said L-shaped member.

5. The apparatus of claim 4, wherein said detent means includes a pair of spaced apertures defined in said tubular member; a finger mounted for pivotal movement into and out of said bore; and spring means for normally biasing said finger into said bore.

6. A gun comprising:

an elongated receiver having a forward end, a rearward end and an undersurface;

a pistol grip emanating outwardly from said undersurface away from said receiver; and stock means including a stock terminating in a butt pivotally mounted to a portion of said receiver behind said pistol grip, said stock means operative between three positions, a first position where said stock means is in close proximity to said pistol grip, a second position where said stock means is placed into a positin suitable for shoulder firing, and a third position where said stock means is placed into a position where the butt of the stock presses up against the armpit of the user, said stock means in said first position being adapted to stabilize said gun while firing by pressing up against the forearm of the hand of the user holding said pistol grip.

7. An apparatus for use with a gun having an elongated receiver including a forward end, a rearward end and an undersurface, said apparatus comprising:

a pistol grip emanating outwardly from said undersurface away from said receiver, the longitudinal axis of said pistol grip being substantially perpendicular to the longitudinal axis of said receiver, the longitudinal axis of said pistol grip intersecting the approximate midpoint of said longitudinal axis of said receiver;

bracket means secured to the distal end of said pistol grip and a portion of said receiver behind said pistol grip for pressing up against the forearm of a user during firing of the gun;

trigger-protecting means emanating downwardly from said receiver ahead of said pistol grip;

a handgrip forming part of said trigger-protecting means and being secured to the undersurface of said receiver ahead of said pistol grip, said handgrip performing the simultaneous functions of defining a portion of a trigger guard and providing a grip for holding the gun during firing; and stock means including a stock terminating in a butt pivotally mounted to a portion of said receiver behind said pistol grip, said stock means operative between three positions, a first position where said stock means mates with said bracket means, a second position where said stock means is placed into a position suitable for shoulder firing and a third position where said stock means is placed into a position where the butt of the stock presses up against the armpit of the user.

8. The apparatus of claim 7, wherein said stock means includes two relatively slidable members for facilitating the operation of said stock means between said positions.

9. The apparatus of claim 7, further comprising locking means for locking said stock means into each of said positions.

10. The apparatus of claim 7, wherein said stock means comprises:

a generally L-shaped member with one leg of the member defining a butt end and the other leg of said member defining a longitudinally extending bore;

an elongated tubular member slidably mounted in said bore; and a pivot joint pivotally connecting the distal end of said tubular member to the rearward end of said elongated receiver.

11. The apparatus of claim 10, further comprising detent means mounted in said L-shaped member for locking said tubular member into either of two different positions within said bore of said L-shaped member.

12. The apparatus of claim 11, wherein said detent means includes a pair of spaced apertures defined in said tubular member; a finger mounted for pivotal movement into and out of said bore; and spring means for normally biasing said finger into said bore.

13. The apparatus of claim 7, wherein said bracket means comprises a generally L-shaped bracket having two legs, the distal end of one of said legs being secured to the distal end of said pistol grip and the distal end of the other of said two legs being secured to the undersurface at the rearward end of said receiver.

14. The apparatus of claim 7, further including trigger means comprising a trigger for activating the firing of said gun, and a trigger guard surrounding and protecting said trigger.

15. The apparatus of claim 14, wherein said handgrip surrounds a predetermined portion of a metallic strip, said handgrip originating at the undersurface of said receiver and extending away therefrom along said metallic strip.

16. A gun comprising:

a receiver having an undersurface;

a pistol grip emanating outwardly from said undersurface away from said receiver;

bracket means secured to the distal end of said pistol grip and the undersurface of the rearward end of said receiver for pressing up against the forearm of a user during firing of the gun;

trigger-protecting means emanating from the undersurface of the front end of said receiver ahead of said pistol grip;

a handgrip forming part of said trigger-protecting means and being secured to the undersurface of the front end of said receiver, said handgrip performing the simultaneous function of defining a portion of a trigger guard and providing a grip for holding the gun during firing;

stock means includng a stock terminating in a butt pivotally mounted to the rearward end of said receiver, said stock means operative between three positions, a first position where said stock means mates with said bracket means, a second position where said stock means is placed into a position suitable for shoulder firing and a third position where said stock means is placed into a position where the butt of the stock presses up against the armpit of the user.

17. The gun of claim 16, wherein the longitudinal axis of said pistol grip is substantially perpendicular to the longitudinal axis of said receiver, the longitudinal axis of said pistol grip intersecting the approximate midpoint of said longitudinal axisof said receiver.

18. An apparatus for use with a gun having an elongated receiver including a forward end, a rearward end and an undersurface, said apparatus comprising:

a pistol grip emanating outwwardly from said undersurface away from said receiver; and a stock including a generally L-shaped member with one leg defining a butt, an elongated member cooperative in a telescoping relationship with the other leg of said L-shaped member, and pivot means for pivotally connecting the distal end of said elongated member to the rearward end of said elongated receiver, said stock operative between at least two positions, a first position where said butt is in close proximity to said pistol grip with said telescoping members being fully contracted and a second position where said butt is pivoted into a position suitable for shoulder firing and said telescoping members are fully extended.

19. The apparatus of claim 19, wherein said other leg of said generally L-shaped member defines a longitudinally extending bore; and said elongated member comprises a tubular member slidably mounted in said bore.

20. The apparatus of claim 19, further comprising detent means mounted in said L-shaped member for locking said tubular member into either of two different positions within said bore of said L-shaped member.

21. The apparatus of claim 20, wherein said detent means includes a pair of spaced apertures defined in said tubular member; a finger mounted for pivotal movement into and out of said bore; and spring means for normally biasing said finger into said bore.

22. The apparatus of claim 18, further comprising stabilizing means positioned below said undersurface and next to said L-shaped member for stabilizing said gun by pressure up against the forearm of the hand holding the pistol grip.

23. The apparatus of claim 22, further comprising means for securing said stabilizing means to said gun.

24. The apparatus of claim 22, further comprising means for securing said stabilizing means to said L-shaped member.

25. The apparatus of claim 18, further comprising means for operatively engaging the distal end of said butt to the distal end of said pistol grip.

26. A gun comprising:

an elongated receiver having a forward end, a rearward end and an undersurface;

a pistol grip emanating outwardly from said undersurface away from said receiver; and a stock including a generally L-shaped member with one leg defining a butt, an elongated member cooperative in a telescoping relationship with the other leg of said L-shaped member, and pivot means for pivotally connecting the distal end of said elongated member to the rearward end of said elongated receiver, said stock means operative between at least two positions, a first position where said butt is in close proximity to said pistol grip with said telescoping members being fully contracted and a second position where said butt is pivoted into a position suitable for shoulder firing.

27. The gun of claim 26, further comprising stabilizing means positioned below said undersurface and next to said L-shaped member for stabilizing said gun by pressing up against the forearm of the hand holding the pistol grip.

28. The gun of claim 27, further comprising means for securing said stabilizing means to said gun.

29. The gun of claim 27, further comprising means for securing said stabilizing means to said L-shaped member.

30. The gun of claim 26, further comprising means for operatively engaging the distal end of said butt to the distal end of said pistol grip.

31. An apparatus for use with a gun having an elongated receiver including a forward end, a rearward end and an undersurface, said apparatus comprising:

a pistol grip emanating outwardly from said undersurface a predetermined distance away from the rearward end of said receiver; and stabilizing means including a generally L-shaped bracket having two legs, the distal ends of said legs being secured respectively to the distal end of said pistol grip and the distal end of the receiver behind said pistol grip, said stabilizing means being confined to the area defined between said undersurface of said receiver and the bottom of said pistol grip and between said rearward end of said receiver and the back of said pistol grip, and said stabilizing means including a forearm receiving portion for stabilizing said gun by pressing up against the forearm of the hand holding said pistol grip.

32. A gun comprising:

an elongated receiver having a forward end, a rearward end and an undersurface;

a pistol grip emanating outwardly from said undersurface a predetermined distance away from the rearward end of said receiver; and stabilizing means including a generally L-shaped bracket having two legs, the distal ends of said legs being secured respectively to the distal end of said pistol grip and the distal end of the receiver behind said pistol grip, said stabilizing means being confined within the area defined between said undersurface of said receiver and the bottom of said pistol grip and between said rearward end of said receiver and the back of said pistol grip, and said stabilizing means including a forearm receiving portion for stabilizing said gun by pressing up against the forearm of the hand holding said pistol grip.

* * * * *

UNITED STATES PATENT AND TRADEMARK OFFICE

CERTIFICATE OF CORRECTION

PATENT NO. : 4,735,007

DATED : April 5, 1988

INVENTOR(S) : Uzi Gal

It is certified that error appears in the above-identified patent and that said Letters Patent is hereby corrected as shown below:

Column 4, line 30 "plane view" should read --plan view--.

Column 8, line 48 "deoote" should read --denote--.

Column 10, line 58 "user desire" should read --user desires--.

Column 12, lines 63-4 "the front grip 84, the pistol grip 84, the pistol grip 22" should read --the front grip 84, the pistol grip 22--.

Column 13, line 1 "elongted" should read --elongated--;

line 62 "positin" should read --position--.

Column 15, line 39 "axisof" should read --axis of--;

line 43 "outwwardly" should read --outwardly--;

line 58 "claim 19" should read --claim 18--.

Column 16, line 14 "claim 18" should read --claim 23--.

Signed and Sealed this

Eighth Day of November, 1988

*Attest:*

*Attesting Officer*

DONALD J. QUIGG

*Commissioner of Patents and Trademarks*